US006072434A

United States Patent [19]

Papatheodorou

[11] Patent Number: 6,072,434

[45] **Date of Patent: *Jun. 6, 2000**

[54] APERTURE-COUPLED PLANAR INVERTED-F ANTENNA

[75] Inventor: Stelios Papatheodorou, Morristown, N.J.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/794,077

[22] Filed: Feb. 4, 1997

[51] Int. Cl.[7] ..... H01Q 1/38; H01Q 1/24

[52] U.S. Cl. ..... 343/700 MS; 343/702; 343/846

[58] Field of Search ..... 343/700 MS, 702, 343/846; H01Q 1/38, 1/24

[56] References Cited

U.S. PATENT DOCUMENTS

| | | | |
|---|---|---|---|
| 4,847,625 | 7/1989 | Dietrich et al. | 343/700 MS |
| 4,899,164 | 2/1990 | McGrath | 343/700 MS |
| 5,043,738 | 8/1991 | Shapiro et al. | 343/700 MS |
| 5,173,711 | 12/1992 | Takeuchi et al. | 343/700 MS |
| 5,627,550 | 5/1997 | Sanad | 343/700 MS |
| 5,801,660 | 9/1998 | Ohtsuka et al. | 343/700 MS |

FOREIGN PATENT DOCUMENTS

WO 97/44846 11/1997 WIPO .

OTHER PUBLICATIONS

I. Park and R. Mittra, "Aperture–Coupled Quarter–Wave Microstrip Antenna," IEEE Antennas and Propagation Society International Symposium 1996, Baltimore, MD., Jul. 21–26, 1996, pp. 14–17.

P. Sullivan and D. Schaubert, "Analysis of an Aperture Coupled Microstrip Antenna," IEEE Transactions on Antennas and Propagation, vol. AP–34, No. 8, Aug. 1986, pp. 977–984.

K. Hirasawa and M. Haneishi, "Analysis, Design and Measurement of Small and Low–Profile Antennas," Artech House, Norwood, Ma., 1992, Ch. 5, pp. 161–180.

I. Park et al., "Aperture–Coupled Small Microstrip Antenna," Electronics Letters, vol. 32, No. 19, pp. 1741–1742, Sep. 12, 1996.

K. Takeuchi et al., "Characteristics of a Slot–Coupled Microstrip Antenna Using High–Permittivity Feed Substrate," Electronics and Communications in Japan, Part I—Communications, vol. 78, No. 3, pp. 85–94, Mar. 1995.

P. Sullivan et al., "Analysis of an Aperture–Coupled Microstrip Antenna," IEEE Transactions on Antennas and Propagation, vol. 34, No. 8, pp. 977–984, Aug., 1986.

K. Kagoshima et al., "Analysis of a Planar Inverted F Antenna Fed By Electromagnetic Coupling," Proc. of the Antennas and Propagation Society International Symposium (APSIS), Chicago, Jul. 20–24, 1992, vol. 3, pp. 1702–1705.

*Primary Examiner*—Hoanganh Le

[57] ABSTRACT

An aperture-coupled planar inverted-F antenna (PIFA) including a radiating patch formed on one side of a ground plane and separated therefrom by a first dielectric which may be air, foam or another suitable material. A shorting strip connects a side of the radiating patch to the ground plane at a point corresponding to a dominant mode null, such that the size of the radiating patch may be reduced by a factor of two. A microstrip feedline is arranged on an opposite side of the ground plane and separated therefrom by a second dielectric which may be part of a substrate formed of printed wiring board material. Signals are coupled between the microstrip feedline and the radiating patch via an aperture formed in the ground plane. The use of aperture coupling avoids the excessive cost associated with conventional TEM transmission line or coaxial feeds, while providing improved manufacturability and ease of integration relative to PIFAs with conventional feeds. Moreover, the aperture coupling provides improved tuning flexibility. For example, a portion of the microstrip feedline may be used as a tuning stub to provide impedance matching on the feedline.

24 Claims, 3 Drawing Sheets

APERTURE-COUPLED PLANAR INVERTED-F ANTENNA

FIELD OF THE INVENTION

The present invention relates generally to antennas for use in cellular, personal communication services (PCS) and other wireless communication equipment and more particularly to a planar inverted-F antenna which utilizes aperture coupling within the antenna feed.

BACKGROUND OF THE INVENTION

The continued growth in wireless communications is demanding personal base stations, portable handsets and other communication terminals that are compact, light and able to perform a variety of functions. Considerable size reductions have already been achieved through the integration and miniaturization of most of the electronic and radio frequency (RF) circuitry in the communication terminal. However, the conventional antennas typically used remain unduly large relative to the terminal. This is particularly true for designs which utilize multiple antennas in order to provide diversity, interference reduction and beamforming. A conventional antenna with a low profile structure suitable for mounting on personal base stations, portable handsets and other communication terminals is known as the planar inverted-F antenna (PIFA).

FIG. 1 illustrates an exemplary PIFA 10 in accordance with the prior art. The PIFA 10 includes a ground plane 12, an $L_p \times W_p$ rectangular radiating patch 14 and a short-circuit plate 16 having a width $d_1$ which is narrower than the width $W_p$ of the radiating patch 14. The short-circuit plate 16 shorts radiating patch 14 to the ground plane 12 along a null of the $TM_{100}$ dominant mode electric field of patch 14. The PIFA 10 may thus be considered a rectangular microstrip antenna in which the length of the rectangular radiating patch 14 is reduced in half by the connection of the short-circuit plate 16 at the $TM_{100}$ dominant mode null. The short-circuit plate 16 supports the radiating patch 14 at a distance $d_2$ above the ground plane 12. The radiating patch 14 is fed by a TEM transmission line 18 from the back of the ground plane 12, at a point located a distance $d_3$ from the short-circuit plate 16. The transmission line 18 has a width $d_4$ and includes an inner conductor 20 surrounded by an outer conductor 22. A detailed analysis of the operation of the conventional PIFA 10 of FIG. 1 may be found in K. Hirasawa and M. Haneishi, "Analysis, Design and Measurement of Small and Low-Profile Antennas," Artech House, Norwood, Mass., 1992, Ch. 5, pp. 161–180, which is incorporated by reference herein. The PIFA 10 is particularly well-suited for use in personal base stations, handsets and other wireless communication terminals because it has a low profile, a large bandwidth and provides substantially uniform coverage, and because it can be implemented using an air dielectric as shown in FIG. 1. The bandwidth of the PIFA 10 may be further increased by using a conducting chassis of a terminal housing as the ground plane 12. This is due to the fact that the radiating patch 14 will then have a size comparable to the ground plane and will therefore induce surface current on the ground plane.

A significant problem with antennas such as the conventional PIFA 10 of FIG. 1 is that the radiating patch is fed by the TEM transmission line 18 or a similar structure such as a coaxial line. This generally makes the PIFA more difficult to manufacture, in that the relative position and other characteristics of the feed must be implemented with a high degree of accuracy, and the outer and center conductors must be properly connected. Moreover, the cost of a TEM transmission line or coaxial line and its associated connector is excessive, and may be several times the cost of the rest of the antenna. In addition, the use of a TEM transmission line or a coaxial line limits the tuning flexibility of the antenna feed in that the characteristics of such lines are not easily adjusted during or after manufacture. A TEM transmission line or a coaxial line may also be relatively difficult to interconnect with related circuitry in a personal base station, portable handset or other communication terminal. These and other factors associated with the use of a TEM transmission line or coaxial line feed unduly increase the cost of the antenna, and prevent its use in many cost-sensitive applications. It would therefore be desirable if an alternative feed mechanism could be developed such that the low profile, large bandwidth and uniform coverage advantages of PIFAs could be provided in personal base stations, handsets and other communication terminals without the drawbacks associated with transmission line feeds such as that shown in FIG. 1.

As is apparent from the above, a need exists for an improved PIFA which avoids the excessive cost of conventional transmission line or coaxial feeds, is simpler to manufacture and integrate with related terminal circuitry, and provides more tuning flexibility, without sacrificing the low profile, large bandwidth and uniform coverage advantages typically associated with PIFAs.

SUMMARY OF THE INVENTION

The present invention provides an improved aperture-coupled planar inverted-F antenna (PIFA) particularly well-suited for use in personal base stations, portable handsets or other terminals of cellular, personal communications service (PCS) and other wireless communication systems. A PIFA in accordance with the invention utilizes an aperture-coupled feed in place of the TEM transmission line or coaxial line feed typically used in conventional PIFAs.

In accordance with one aspect of the invention, an aperture-coupled PIFA is provided which includes a radiating patch arranged on one side of a ground plane and separated therefrom by a first dielectric. The first dielectric may be an air dielectric or part of an antenna substrate constructed of foam or another suitable dielectric material. A shorting strip connects a side of the radiating patch to the ground plane and may also support the radiating patch in an embodiment in which the first dielectric is an air dielectric. The shorting strip shorts the radiating patch at a point corresponding to a dominant mode null such that the size of the radiating patch may be reduced by a factor of two relative to the patch size required without the shorting strip. The shorting strip may be connected at any point along a side of a rectangular radiating patch. For example, the shorting strip may be connected to an approximate midpoint of the edge. A microstrip feedline is arranged on an opposite side of the ground plane and is separated therefrom by a second dielectric. The second dielectric may be part of a feedline substrate having an upper surface and a lower surface, with the ground plane adjacent the upper surface and the feedline adjacent the lower surface. The feedline substrate may be formed using conventional printed wiring board materials, and may be part of a printed wiring board in a personal base station, handset or other communication terminal incorporating the PIFA. Signals are coupled between the radiating patch and the feedline via an aperture formed in the ground plane. The PIFA of the present invention thus avoids the excessive cost associated with conventional transmission line or coaxial line feeds. The PIFA of the present invention is also generally easier to manufacture than a conventional PIFA, in that there is no need to provide precise positioning and connections for the center and outer conductors of a TEM transmission line or coaxial line. Moreover, the use of aperture coupling provides improved tunability in that adjustments may be made to antenna parameters such as the length and width of the feedline, the size and shape of the aperture, the position and size of the shorting strip and the relative proximity of the shorting strip and aperture.

In accordance with another aspect of the invention, improved tunability may be provided by utilizing a portion of the microstrip feedline as a tuning stub. For example, the feedline may be configured to have a total length of $L_f+L_t$, where $L_f$ is the length of a first portion of the feedline from an input of the feedline to the aperture, and $L_t$ is the length of a remaining tuning stub portion of the feedline extending past the aperture. The impedance seen from the feedline referenced at the aperture may be characterized as a series combination of an equivalent impedance Z representing the combined effect of the aperture and radiating patch, and an impedance of the tuning stub portion of the feedline. Impedance matching can then be provided by selecting the real part of the equivalent impedance Z as substantially equivalent to the characteristic impedance of the feedline, while selecting the impedance of the tuning stub portion to offset any imaginary part of the equivalent impedance Z. In an exemplary embodiment, an impedance match providing a voltage standing wave ratio (VSWR) of 2.0 or better is achieved over a bandwidth of about 200 MHZ at frequencies on the order of 2 GHz.

The present invention thus provides a planar inverted-F antenna which avoids the excessive cost of conventional TEM transmission line or coaxial feeds, and exhibits improved manufacturability, tuning flexibility and ease of integration relative to planar inverted-F antennas with conventional feeds. Moreover, these improvements are provided without sacrificing the low profile, large bandwidth and uniform coverage features typically associated with planar inverted-F antennas. These and other features and advantages of the present invention will become more apparent from the accompanying drawings and the following detailed description.

DETAILED DESCRIPTION OF THE INVENTION

Figure 1:
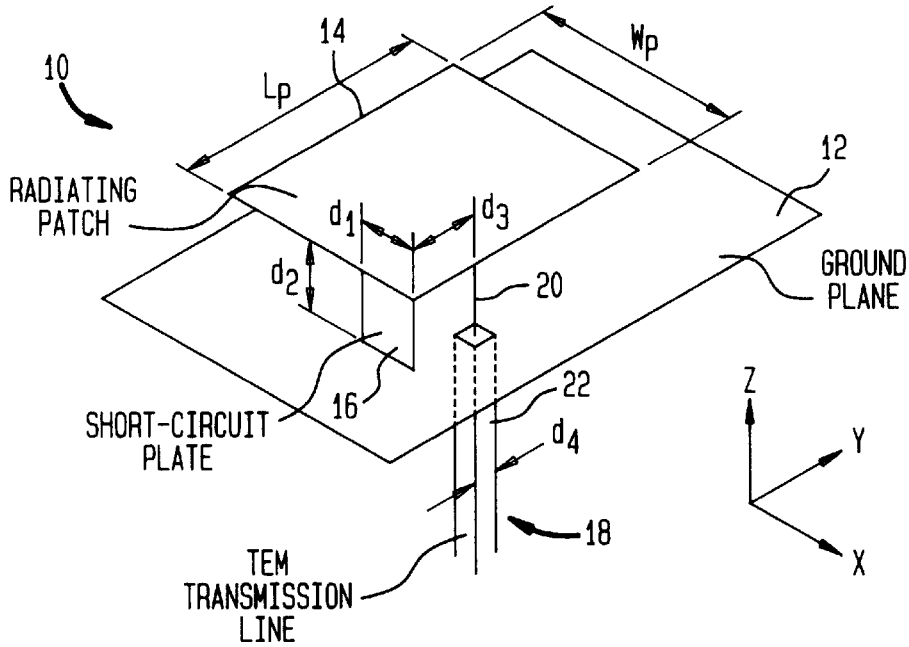
FIG. 1 (PRIOR ART)
FIG. 1 shows a planar inverted-F antenna (PIFA) in accordance with the prior art.

The present invention will be illustrated below in conjunction with an exemplary aperture-coupled planar inverted-F antenna (PIFA). It should be understood, however, that the invention is not limited to use with any particular PIFA configuration, but is instead more generally applicable to any PIFA in which it is desirable to provide improved manufacturability, tunability or ease of integration without undermining the low profile, large bandwidth and uniform coverage advantages of the antenna. The term "PIFA" as used herein is thus intended to include not only the illustrative configurations, but also any antenna having a radiating patch suspended above a ground plane and shorted to the ground plane in at least one location. The term "aperture" as used herein in the context of aperture coupling is intended to include not only the illustrative rectangular apertures of the exemplary embodiments, but also apertures having a variety of other shapes and sizes. The term "shorting strip" as used herein is intended to include a metallic strip, plate, pin, lead or trace as well as any other conductive interconnect used to short a radiating patch to a ground plane. For example, a shorting strip in an aperture-coupled PIFA of the present invention may be implemented in the form of a short-circuit plate such as plate 16 shown in FIG. 1. It should be noted that the term "coupling" as used herein is intended to include the coupling of transmit signals from the feedline to the radiating patch of a PIFA as well as the coupling of received signals from the radiating patch to the feedline.

Figure 2:
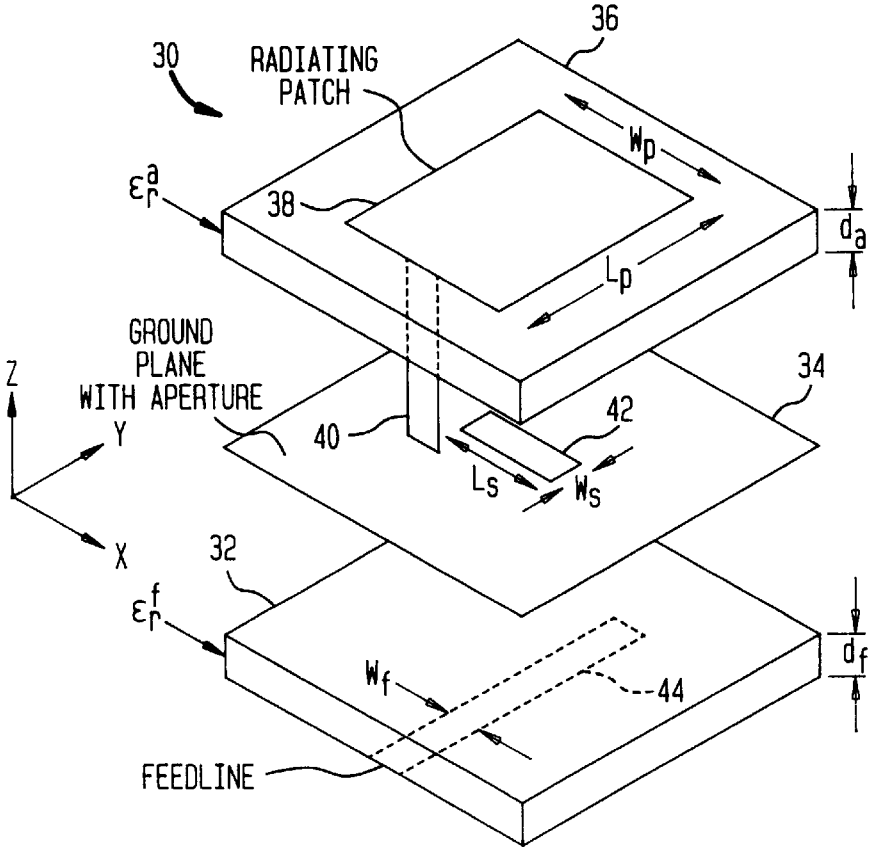
FIG. 2 shows an exploded view of an aperture-coupled PIFA in accordance with an exemplary embodiment of the present invention.

FIG. 2 shows an exploded view of an aperture-coupled PIFA 30 in accordance with an exemplary embodiment of the present invention. The PIFA 30 includes a feedline substrate 32, a ground plane 34 and an antenna substrate 36. The antenna substrate 36 in this embodiment will be assumed to represent an air dielectric having a thickness $d_a$, but in alternative embodiments the antenna substrate 36 may be formed using other materials, such as foam, having a dielectric constant $\epsilon_r^a$. A rectangular radiating patch 38 having a width $W_p$ and a length $L_p$ is formed in a plane corresponding to an upper surface of the substrate 36. Although the patch length $L_p$ is shown as greater than the patch width $W_p$ in the illustrative embodiment of FIG. 2, this is not a requirement of the invention. The radiating patch 38 is shorted to the ground plane 34 by a narrow metallic strip 40 connected to one side of the patch 38 as shown. The metallic strip 40 may also serve to support the radiating patch 38 in an embodiment in which the substrate 36 represents an air dielectric. In embodiments in which the substrate 36 is formed of foam or other material, the substrate 36 may provide complete or partial support for the radiating patch 38. The metallic strip 40 is connected at approximately the midpoint of a side of the rectangular radiating patch 38 in the exemplary embodiment of FIG. 2. This arrangement provides a short-circuit rectangular microstrip antenna that resonates near the frequency of a patch of length $2L_p$, and thus allows the size of the radiating patch 38 to be reduced by a factor of two relative to the patch size required without the shorting strip. It should be noted that the dimensions of the various elements of PIFA 30 are not drawn to scale, and the relative dimensions shown in this illustrative example should not be construed as limiting the invention to any particular embodiment or group of embodiments.

The ground plane 34 includes a rectangular slot or aperture 42 having a length $L_s$ and a width $W_s$. The ground plane is supported in this embodiment by the feedline substrate 32 which may be formed of dielectric materials such as those utilized in conventional printed wiring boards. The feedline substrate 32 has a dielectric constant $\epsilon_r^f$ and a thickness $d_f$, and may be part of an existing substrate layer of a printed wiring board in a personal base station, portable handset or other communications terminal. A microstrip feedline 44 having a width $W_f$ is formed on a lower surface of the feedline substrate 32. The feedline 44 has a total length $L_f+L_t$ which extends beyond the aperture 42. The initial portion of the feedline 44 up to the aperture 42 has length $L_f$, while the portion of the feedline 44 extending beyond the aperture 42 has length $L_t$ and is used as a tuning stub to provide improved tunability in a manner to be described in greater detail below.

In the PIFA 30 of FIG. 2, the radiating patch 38 is fed electromagnetically via the combination of the feedline 44 and the aperture 42 rather than via a TEM transmission line or coaxial line as in a conventional PIFA. The PIFA 30 therefore avoids the excessive cost associated with the TEM transmission line or coaxial line feeds. The PIFA 30 is also generally easier to manufacture than a conventional PIFA, in that there is no need to provide precise positioning and connections for the center and outer conductors of the TEM transmission line or coaxial line. Moreover, the use of the feedline 44 provides improved tunability in that adjustments may be made in PIFA 30 to antenna parameters such as the length of the feedline 44, the size and shape of the aperture 42, and the relative proximity of the shorting strip 40 and aperture 42. These and other similar adjustments are not possible in the conventional PIFA 10 described in conjunction with FIG. 1 above. It will be shown in conjunction with FIGS. 4, 5 and 6 below that these improvements are provided without undermining the large bandwidth and substantially uniform coverage attributes commonly associated with PIFAs.

Figure 3:
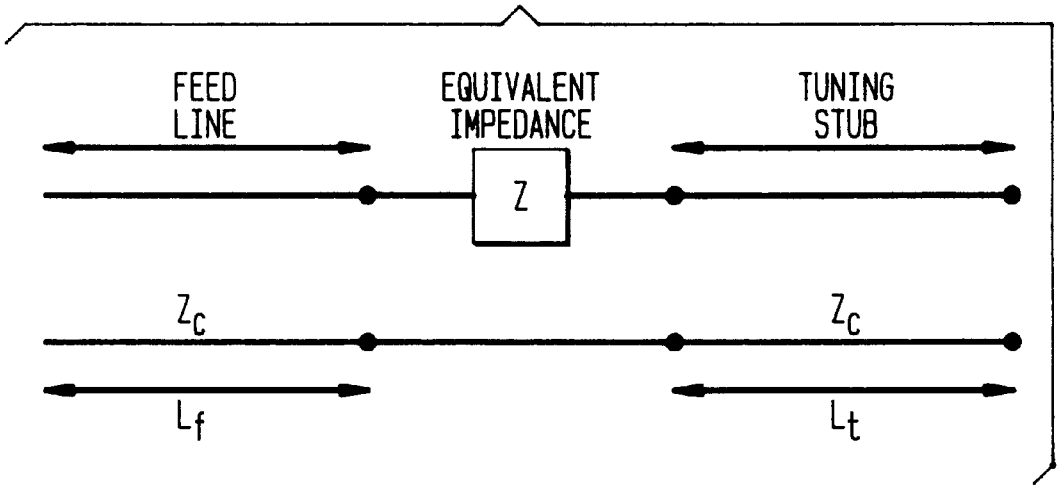
FIG. 3 is an equivalent circuit illustrating tuning features of the aperture-coupled PIFA of FIG. 2.

FIG. 3 is an equivalent circuit illustrating tuning features of the aperture-coupled PIFA of FIG. 2. The portion of the feedline 44 beyond the aperture 42 is terminated in an open circuit and acts as a tuning stub having a variable length $L_t$ and a characteristic impedance $Z_c$. The initial portion of the feedline 44 up to the aperture 42 has length $L_f$ and characteristic impedance $Z_c$. The combined effect of the aperture 42 and the radiating path 38 is seen by the feedline 44 referenced at the aperture 42 as an equivalent impedance Z in series with the tuning stub portion of feedline 44. Impedance matching is achieved in the equivalent circuit of FIG. 3 when the real part of the equivalent impedance Z is substantially equal to the characteristic impedance $Z_c$ of the feedline 44, while any imaginary part of the equivalent impedance Z is substantially canceled out by the tuning stub portion of the feedline 44. It will be shown below that this impedance matching condition can be achieved over a relatively large bandwidth.

Figure 4:
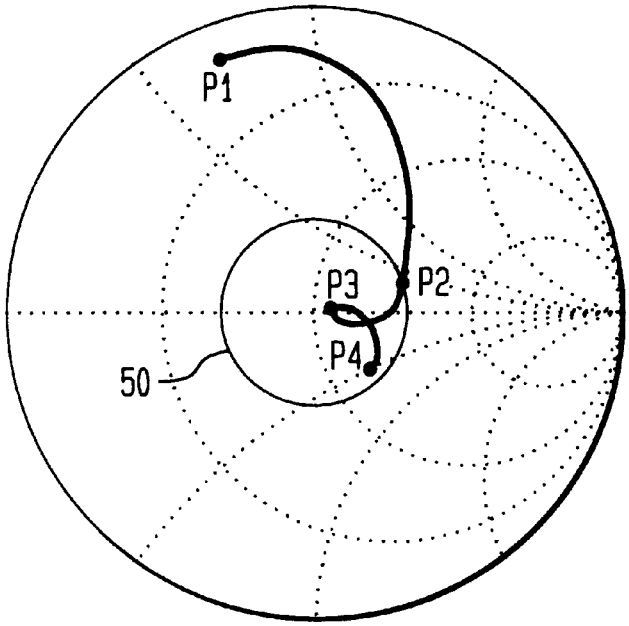
FIG. 4 is a Smith chart plot illustrating the input impedance of an exemplary implementation of the aperture-coupled PIFA of FIG. 2 as a function of frequency.

FIG. 4 is a Smith chart plot illustrating the input impedance of an exemplary implementation of the aperture-coupled PIFA 30 of FIG. 2 as a function of frequency. The Smith chart plots the input impedance of the feedline 44 for frequencies in the range between about 1.9 GHz and 2.3 GHz. In generating the impedance measurements of FIG. 4, the PIFA 30 of FIG. 2 was assumed to be configured with a radiating patch 38 having a length $L_p$ of about 27.5 mm and a width $W_p$ of about 50.0 mm. It was also assumed that the ground plane 34 was an infinite ground plane. The radiating patch 38 was separated from the ground plane 34 by an air dielectric or low dielectric foam antenna substrate 36 having a thickness $d_a$ of about 10 mm. A shorting strip 40 having a width of about 1 mm was used to short the radiating patch 38 to the ground plane 34. The shorting strip 40 was connected to the approximate midpoint of the 50.0 mm side of the rectangular radiating patch in a manner similar to that shown in FIG. 2. The aperture 42 of ground plane 34 was configured with a length L, of about 55 mm and a width $W_s$ of about 2 mm. The center of the aperture 42 was symmetrically placed with respect to the radiating patch 38 above it and its distance from the shorting strip 40 was set to about 2 mm. The ground plane 34 was in contact with the upper surface of the feedline substrate 32. The feedline substrate 32 had a thickness $d_f$ of about 0.5 mm and a dielectric constant $\epsilon_r^f$ of about 3.8. The microstrip feedline 44 on the lower surface of the feedline substrate 32 had a width $W_f$ of about 1 mm and a total length $L_f+L_t$ of approximately 30 mm. The length $L_t$ of the tuning stub portion of the feedline 44 was selected to be about 2.5 mm.

The Smith chart plot of FIG. 4 shows the variation of input impedance of feedline 44 from a start frequency of about 1.9 GHz corresponding to point P1 to a stop frequency of about 2.3 GHz corresponding to point P4. The circle 50 represents a constant voltage standing wave ratio (VSWR) circle. All impedance points in the Smith chart plot falling on or within the constant VSWR circle will provide a VSWR of 2.0 or less at the input of the feedline 44. A VSWR of 2.0 corresponds to an input S11 value of about −10 dB, indicating that a reflection of an input signal applied to the feedline 44 will have a power level about 10 dB below that of the input signal itself. In a PIFA configured with the above-described exemplary parameters, the input impedance at the start frequency of 1.9 GHz, corresponding to point P1 on the Smith chart, creates a substantial impedance mismatch along the feedline 44 and thus high VSWR and S11 values. As the operating frequency is increased, the input impedance curve enters the constant VSWR circle 50 at a point P2 which corresponds to a frequency of about 2.09 GHz. The point P2 falls on the constant VSWR circle 50 and thus has a VSWR of 2.0 and an S11 value of about −10 dB. The remaining frequencies up to 2.3 GHZ are all within the constant VSWR circle 50 and therefore all result in a VSWR of less than 2.0 and S11 values of better than −10 dB. The point P3 falls near a zero reactance line on the Smith chart and corresponds to a frequency of about 2.2 GHz. As noted above, the point P4 corresponds to the stop frequency 2.3 GHz of the plotted input impedance curve. The input impedance plot of FIG. 4 indicates that the feedline 44, aperture 42 and radiating patch 38 can be well-matched over a relatively large bandwidth. For example, a PIFA configured with the exemplary parameters given above can provide an input VSWR of 2.0 or better over a bandwidth of more than 200 MHz.

Figure 5:
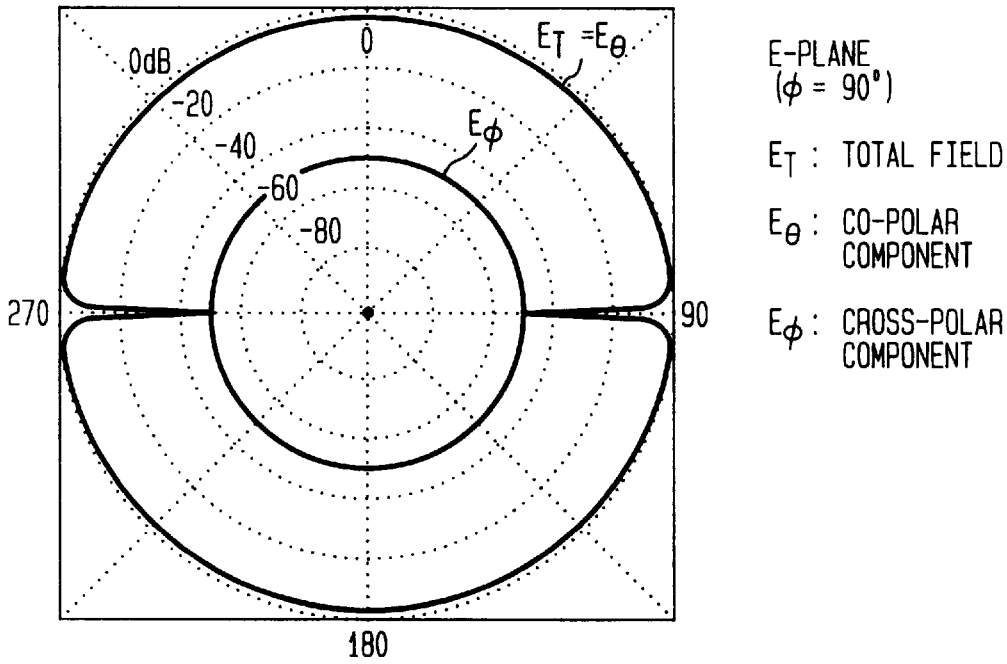
FIGS. 5 and 6 are far-field plots of respective E and H planes illustrating the uniform coverage provided by the exemplary aperture-coupled PIFA of FIG. 2.
Figure 6:
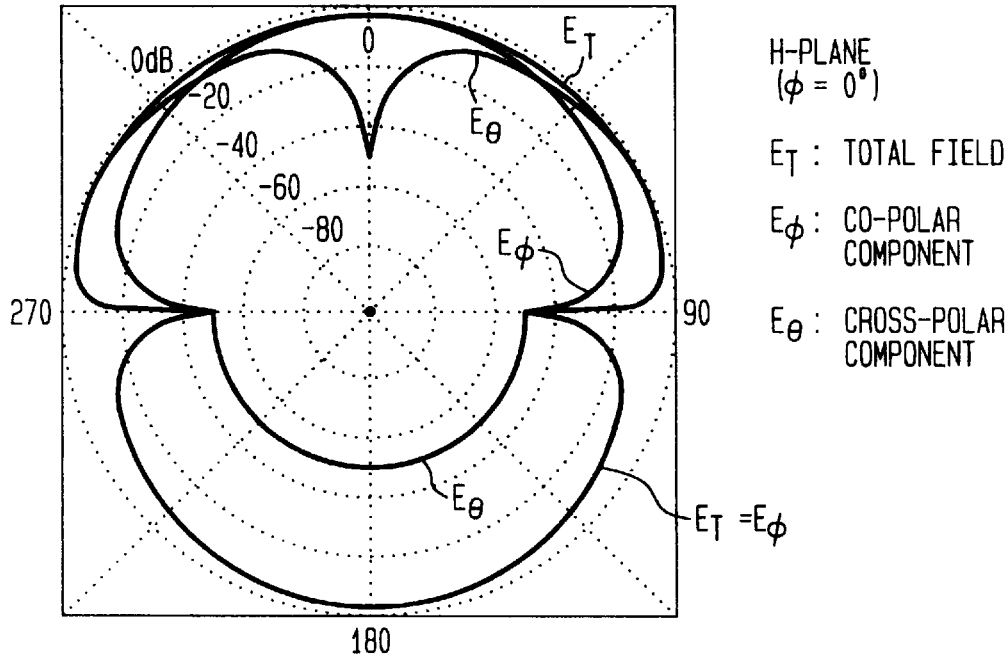

FIGS. 5 and 6 show computed far-field plots for the respective E and H planes illustrating the coverage provided by the aperture-coupled PIFA 30 of FIG. 2. The PIFA 30 was assumed to be configured with the same exemplary parameters described above in conjunction with FIG. 4. The E plane plot of FIG. 5 shows a total field $E_T$, a co-polar component $E_\theta$ and a cross-polar component $E_\phi$ for a $\phi$ value of 90°. The total field $E_T$ is equivalent to the co-polar component $E_\theta$ in the FIG. 5 plot. The H plane plot of FIG. 6 shows a total field $E_T$, a co-polar component $E_\phi$ and a cross-polar component $E_\theta$ for a $\phi$ value of 0°. The plots indicate field strength as a function of direction around a point at the center of each plot. Each of the plots includes five concentric circles surrounding the center point, with each concentric circle corresponding to an additional increase of approximately 20 dB in field strength relative to the field strength at the center point. The fifth and outermost concentric circle may thus be considered a 0 dB circle, with the fourth, third, second and first concentric circles corresponding to relative field strengths of −20 dB, −40 dB, −60 dB and −80 dB, respectively, and the center point corresponding to a relative field strength of −100 dB. The fields are plotted over a full 360° around the center point. It can be seen that the PIFA 30 of FIG. 2 provides a substantially uniform coverage over the full 360° with a directivity comparable to that provided by much larger dipole antennas. The E and H plane plots of FIGS. 5 and 6 exhibit maxima around the 90° and 270° points, and sharp minima at the 90° and 270° points. The sharp minima are attributable to the above-noted assumption of an infinite ground plane. The presence of the shorting strip 40 in the PIFA 30 of FIG. 2 results in cross-polar components having a slightly higher level than those of a conventional aperture-coupled microstrip patch antenna. However, this feature may improve the antenna performance in a multipath environment such as the interior of a building where there is a strong presence of cross-polar components and a fixed antenna orientation is not required. It should be noted that the position of the shorting strip 40 relative to the radiating patch 38 may be used as a mechanism for adjusting the far-field performance of the PIFA 30. For example, although the shorting strip 40 is connected to patch 38 near the midpoint of the side in the illustrative embodiments described above, the shorting strip position could be moved closer to a corner of the side of patch 38 in order to alter the cross-polar components, the position of the maxima and thus the directivity of the far-field radiation plot. The shorting strip 40 could thus be moved, for example, about 10 mm from the midpoint of a side toward a corner of the radiating patch 38 in order to redirect the maxima toward the 0° angle in the plots of FIGS. 5 and 6. The position of the shorting strip 40 may also be varied to adjust impedance matching conditions.

The present invention utilizes aperture coupling in a PIFA in order to avoid the excessive cost of conventional TEM transmission line or coaxial feeds, and to improve manufacturability, tunability and ease of integration relative to PIFAs which utilize conventional TEM transmission line or coaxial line feeds. The resulting aperture-coupled PIFA is particularly well-suited for use as a replacement for existing extension antennas in wall-mounted or desktop personal base stations, portable handsets and other types of wireless communication terminals. The aperture-coupled PIFA of the present invention provides a low profile, a large operating bandwidth and substantially uniform coverage in a multipath environment, with a gain and directivity comparable to that provided by much larger dipole antennas.

The above-described embodiments of the invention are intended to be illustrative only. Alternative embodiments may be implemented by altering the size and shape of the radiating patch 38, the size and shape of the aperture 42, the size, shape and relative position of the shorting strip 40 and the characteristics of the feedline 44. For example, although the feedline 44 is shown as having a constant width in the embodiment of FIG. 2, it should be apparent that application of conventional impedance matching techniques to the feedline may produce a non-uniform width. Such techniques may involve providing an impedance matching transformer at the input of the feedline in the form of a length of transmission line having a larger or smaller width than the remaining portion of the feedline. Numerous other alternative embodiments may be devised by those skilled in the art without departing from the scope of the following claims.

What is claimed is:

1. An antenna comprising:

a ground plane having an aperture formed therein;

a radiating patch formed on one side of the ground plane and separated therefrom by a first dielectric;

a feedline arranged on an opposite side of the ground plane and separated therefrom by a second dielectric, such that signals are coupled between the feedline and the radiating patch via the aperture; and a single shorting strip located proximate to an edge of the radiating patch, away from a corner of the edge, and connecting the radiating patch to the ground plane, such that a dimension of the radiating patch required for resonance is reduced by a factor of approximately one-half, and wherein a position of the shorting strip along the edge of the radiating patch is selected to alter a characteristic of a radiation pattern of the antenna.

2. The antenna of claim 1 wherein the first dielectric separating the radiating patch from the ground plane is an air dielectric.

3. The antenna of claim 1 wherein the first dielectric is part of a first substrate having an upper surface and a lower surface, wherein the radiating patch is adjacent the upper surface of the first substrate and the ground plane is adjacent the lower surface of the first substrate.

4. The antenna of claim 1 wherein the second dielectric separating the feedline from the ground plane is formed of a printed wiring board material.

5. The antenna of claim 1 wherein the second dielectric is part of a second substrate having an upper surface and a lower surface, wherein the ground plane is adjacent the upper surface of the second substrate and the feedline is adjacent the lower surface of the second substrate.

6. The antenna of claim 1 wherein the second dielectric is part of a printed wiring board in a communication terminal in which the antenna is installed.

7. The antenna of claim 1 wherein the shorting strip is connected to the radiating patch at a position selected to provide a desired far-field performance characteristic for the antenna.

8. The antenna of claim 1 wherein the feedline includes a first portion and a second portion arranged such that an impedance seen from the feedline referenced at the aperture includes a series combination of an equivalent impedance representing the combined effect of the aperture and radiating patch, and an impedance of the second portion of the feedline.

9. The antenna of claim 8 wherein the second portion of the feedline serves as a tuning stub to provide impedance matching on the feedline.

10. The antenna of claim 8 wherein the aperture is configured such that a real part of the equivalent impedance of the aperture and radiating patch is substantially equivalent to a characteristic impedance of the feedline.

11. The antenna of claim 8 wherein the second portion of the feedline is configured such that the impedance of the second portion of the feedline offsets an imaginary part of the equivalent impedance of the aperture and radiating patch.

12. The apparatus of claim 1 wherein the aperture has a length which is greater than a width of the radiating patch.

13. A signal directing method for use in an antenna, the method comprising the steps of:

arranging a radiating patch of the antenna on one side of a ground plane having an aperture formed therein, such that the radiating patch is separated from the ground plane by a first dielectric;

arranging a feedline on an opposite side of the ground plane such that the feedline is separated from the ground plane by a second dielectric and signals may be coupled between the feedline and the radiating patch via the aperture; and connecting the radiating patch to the ground plane via a single shorting strip proximate to an edge of the radiating patch and away from a corner of the edge, such that a dimension of the radiating patch required for resonance is reduced by a factor of approximately one-half, and wherein a position of the shorting strip along the edge of the radiating patch is selected to alter a characteristic of a radiation pattern of the antenna.

14. The method of claim 13 wherein the step of arranging a radiating patch of the antenna further includes arranging the radiating patch such that the first dielectric separating the radiating patch from the ground plane is an air dielectric.

15. The method of claim 13 wherein the step of arranging a radiating patch of the antenna further includes arranging the radiating patch such that the first dielectric is part of a first substrate having an upper surface and a lower surface, wherein the radiating patch is adjacent the upper surface of the first substrate and the ground plane is adjacent the lower surface of the first substrate.

16. The method of claim 13 wherein the step of arranging a feedline further includes arranging the feedline such that the second dielectric separating the feedline from the ground plane is formed of a printed wiring board material.

17. The method of claim 13 wherein the step of arranging a feedline further includes arranging the feedline such that the second dielectric is part of a second substrate having an upper surface and a lower surface, wherein the ground plane is adjacent the upper surface of the second substrate and the feedline is adjacent the lower surface of the second substrate.

18. The method of claim 13 wherein the step of arranging a feedline further includes arranging the feedline such that the second dielectric is part of a printed wiring board in a communication terminal in which the antenna is installed.

19. The method of claim 13 wherein the radiating patch is a rectangular patch, and the step of connecting the radiating patch to the ground plane via a shorting strip further includes the step of positioning the shorting strip to provide a desired far-field performance characteristic for the antenna.

20. The method of claim 13 wherein the step of arranging a feedline further includes arranging the feedline such that an impedance seen from the feedline referenced at the aperture includes a series combination of an equivalent impedance representing the combined effect of the aperture and radiating patch, and an impedance of the second portion of the feedline.

21. The method of claim 20 further including the step of using the second portion of the feedline as a tuning stub to provide impedance matching on the feedline.

22. The method of claim 20 further including the step of configuring the aperture such that a real part of the equivalent impedance of the aperture and radiating patch is substantially equivalent to a characteristic impedance of the feedline.

23. The method of claim 20 further including the step of configuring the second portion of the feedline such that the impedance of the second portion of the feedline offsets an imaginary part of the equivalent impedance of the aperture and radiating patch.

24. The method of claim 13, wherein the aperture has a length which is greater than a width of the radiating patch.

* * * * *